US005102008A

United States Patent [19]

Kaufman et al.

[11] Patent Number: 5,102,008

[45] Date of Patent: Apr. 7, 1992

[54] INTERACTIVE MEDICATION DELIVERY SYSTEM FOR PILLS AND CAPLETS PREPACKAGED ON STRIPS

[75] Inventors: Stephen B. Kaufman, Highland Park; Aleandro DiGianfilippo, Crystal Lake; Tamara L. Sager, Libertyville; James R. Hitchcock, Jr., Barrington; Mitchell S. Budniak, Highland Park, all of Ill.

[73] Assignee: Healthtech Services Corporation, Northbrook, Ill.

[21] Appl. No.: 414,960

[22] Filed: Sep. 29, 1989

[51] Int. Cl.[5] ..... G07F 11/66

[52] U.S. Cl. ..... 221/25; 221/72; 221/30

[58] Field of Search ..... 221/25, 30, 69, 71, 221/72, 73, 2, 3; 368/10, 416

[56] References Cited

U.S. PATENT DOCUMENTS

| | | | |
|---|---|---|---|
| 3,340,789 | 9/1967 | Simjiam | 221/25 |
| 3,369,697 | 2/1968 | Glucksman | 221/9 |
| 3,395,829 | 8/1968 | Cogdell et al. | 221/15 |
| 3,651,984 | 3/1972 | Redenbach | 221/3 |
| 3,722,739 | 3/1973 | Blumberg | 221/3 |
| 3,762,601 | 10/1973 | McLaughlin | 221/2 |
| 3,815,780 | 6/1974 | Bauer | 221/5 |
| 3,857,383 | 12/1974 | Sommerfield et al. | 128/2 D |
| 3,911,856 | 10/1975 | Ewing | 116/121 |
| 3,917,045 | 11/1975 | Williams et al. | 194/4 C |
| 3,964,638 | 6/1976 | Diamauro | 221/3 |
| 3,968,900 | 7/1976 | Stambuk | 221/3 |
| 3,998,356 | 8/1976 | Christensen | 221/3 |
| 4,034,740 | 7/1977 | Atherton et al. | 128/1 B |
| 4,034,757 | 7/1977 | Glover | 128/260 |
| 4,130,881 | 12/1978 | Haessler et al. | 364/900 |
| 4,207,992 | 6/1980 | Brown | 221/15 |
| 4,223,801 | 9/1980 | Carlson | 221/3 |
| 4,227,526 | 7/1981 | Goss | 364/416 |
| 4,258,354 | 3/1981 | Carmon et al. | 340/309.4 |
| 4,275,384 | 6/1981 | Hicks et al. | 340/309.4 |
| 4,360,125 | 11/1982 | Martindale et al. | 221/2 |

(List continued on next page.)

OTHER PUBLICATIONS

Pending patent application (Ser. No. 07/201,779) filed 6/2/88; Kaufman et al.

Comarchero et al., "*A Micro-Computer Based System for the Management of the Critically Ill*", 1978.

Blum et al., "*Protocol Directed Patient care Using a Computer*", (1980).

Rodhard et al., "*A Data Management Program to Assist with Home Monitoring of Blood Glucose and Self Adjustment of Insulin Dosage For Patient with Diabetes Mellitus and Their Physicians*", (1984).

Kouchoukos et al., "*Automated Patient care Following Cardiac Surgery*", (1971).

Hudson et al., "*Microcomputer-Based Expert System for Clinical Decision-Making*", (1981).

Worthman et al., "*Quality Assessment in Emergency Medical Services Systems: The Criteria Mapping Method*", (1979).

Greenfield et al., "*The Clinical Investigation and Management of Chest Pain in an Emergency Department*", (1977).

Sanders et al., "*Micro-Computer Controlled care System for the Severely Physically Impaired*", (1984).

*Primary Examiner*—Robert P. Olszewski
*Assistant Examiner*—Kenneth Noland
*Attorney, Agent, or Firm*—Fuller, Ryan & Hohenfeldt

[57] ABSTRACT

A dispensing device for medication that has been prepackaged in individual pockets along a strip includes a first holder for securing one end of the strip and a second holder for securing the opposite end of the strip. A drive mechanism advances the strip along a predetermined path leading from the first holder, through a dispensing mechanism and to the second holder. The dispensing mechanism has a first assembly that moves into contact with the strip and opens a medication pocket. A second assembly presses against the strip as it is further advanced to expel the medication from the opened pocket.

11 Claims, 11 Drawing Sheets

U.S. PATENT DOCUMENTS

| | | | |
|---|---|---|---|
| 4,361,408 | 11/1982 | Wirtschafter | 368/10 |
| 4,367,955 | 1/1983 | Ballew | 368/10 |
| 4,382,688 | 5/1983 | Machamer | 368/10 |
| 4,385,958 | 5/1983 | Long | 221/73 |
| 4,419,016 | 12/1983 | Zoltan | 368/10 |
| 4,448,541 | 5/1984 | Wirtschafter | 368/10 |
| 4,473,884 | 9/1984 | Behl | 364/479 |
| 4,483,626 | 11/1984 | Noble | 368/10 |
| 4,490,711 | 12/1984 | Johnston | 340/10 |
| 4,504,153 | 3/1985 | Schollmeyer et al. | 368/10 |
| 4,526,474 | 7/1985 | Simon | 368/10 |
| 4,572,403 | 2/1986 | Benaroya | 221/3 |
| 4,573,606 | 3/1985 | Lewis et al. | 221/3 |
| 4,616,316 | 10/1986 | Hanpeter et al. | 364/413 |
| 4,674,651 | 6/1987 | Scidmore et al. | 221/3 |
| 4,674,652 | 6/1987 | Aten et al. | 221/3 |
| 4,695,954 | 9/1987 | Rose et al. | 364/413 |
| 4,712,562 | 12/1987 | Ohayon et al. | 128/672 |
| 4,725,997 | 2/1988 | Urquhart et al. | 368/10 |
| 4,731,726 | 3/1988 | Allen | 364/416 |
| 4,733,797 | 3/1988 | Haber | 221/25 |
| 4,776,016 | 10/1988 | Hansen | 381/42 |
| 4,803,625 | 2/1989 | Fu et al. | 364/413.03 |

INTERACTIVE MEDICATION DELIVERY SYSTEM FOR PILLS AND CAPLETS PREPACKAGED ON STRIPS

FIELD OF THE INVENTION

The invention generally relates to systems for dispensing medications. In a more particular sense, the invention concerns systems which oversee and coordinate the administration of complex, medication regimens at home, outside the support system of a hospital or pharmacy, and without the day to day supervision of medical personnel. In this more particular sense, the invention also concerns automated home care patient health monitoring systems.

BACKGROUND OF THE INVENTION

Due to advances in medicine and medical treatments in general, people are living longer. As a result, the number and percentage of older people are growing in the United States and elsewhere.

However, despite medical advances, many elderly people still face chronic and debilitating health problems. Arthritis, hypertension, and heart conditions are but a few examples of the problems associated with longevity.

Treatment of these health problems often requires close compliance with relatively complex medication regimes. It is not unusual for a person having one of the above health problems to be taking four or more different prescription drugs at one time. These drugs often differ significantly in dosages, both as to time and amount, as well as in their intended physiological effects. These drugs also often differ in the severity of potentially adverse reactions due to mismedication.

Close and careful compliance with these complex medication regimes is a difficult task in itself. The difficulty is greatly enhanced, considering that the .elderly must discipline themselves to follow these regimes at home, without the day-to-day support and supervision of trained hospital and pharmacy personnel, and often without the day-to-day support and supervision of their immediate families or other caregivers. Furthermore, a loss in short term memory can be naturally attributed to ,the aging process and to the medication themselves, resulting in forgetfulness and further confusion in scheduling compliance with complicated medication regimes.

The elderly are therefore increasingly at risk of hospitalization or death from mismedication.

An interactive patient assistance device, ideally suited to the needs of home care patients—young and old alike—is described in Kaufman et al. U.S. Pat. No. 201,779 (filed June 2, 1988). The device includes a self-contained medication delivery mechanism and self-contained physical testing apparatus. The device normally retains the medication and the testing apparatus away from access by the patient. Both medication and the testing apparatus are made available to the patient, either in response to a prescribed schedule or in response to a verbal command made by the patient.

The present invention enhances and expands the flexible, interactive system described in the Kaufman et al. application.

The invention is directed to improving the overall well-being and lifestyle of home care patients who are on complicated medication regimes. The invention addresses the problems of compliance with a complicated regime of differing medications and solves these problems by providing a reasonable degree of self-sufficiency and personal control over the administration of medication without sacrificing the overall therapeutic objectives of the prescribed medical treatment.

SUMMARY OF THE INVENTION

The invention provides a dispensing device for medication that has been prepackaged in individual pockets along a strip.

The dispensing device includes a first holder for securing one end of the strip, a second holder for securing the opposite end of the strip, and a dispensing mechanism for dispensing medication from the strip. A drive mechanism advances the strip along a predetermined path leading from the first holder, through the dispensing mechanism and to the second holder.

The dispensing mechanism includes a first assembly that can be moved into contact with the strip to open a medication pocket. The dispensing mechanism also includes a second assembly that, as the strip is advanced, presses against the strip to expel the medication from the opened pocket.

The device further includes a control mechanism that advances the strip to bring a medication pocket into the first assembly, then actuates the first assembly to open the pocket, and then further advances the opened pocket into second assembly to expel the medication from the pocket.

In a preferred embodiment, the first holder is a supply reel for holding the strip in roll form, and the second holder is a take up reel. In this arrangement the drive mechanism advances the strip by winding the strip onto the take up reel while unwinding the strip from the supply reel.

Also in a preferred embodiment, the first assembly includes a punch member that cuts the strip to open a flap in the pocket. In this arrangement, the second assembly includes a surface having an edge and an associated member that together form a restricted passage through which the strip passes as it is advanced. In the restricted passageway, the member presses the advancing strip against the edge to expel the medication through the open flap.

In a preferred embodiment, the control mechanism includes an optical sensor that senses the location of medication pockets along the strip. The sensor generates a control signal when a medication pocket is in operative alignment with the dispensing mechanism.

The invention also provides a medication delivery system that includes a housing containing separate first and second storage locations for holding medication dosages away from access by the patient. Associated separate first and second delivery mechanisms permit selective delivery of a medication dose from either the first or second storage locations to the patient. At least one of the storage locations and associated dispenser contains medication that has been prepackaged on a strip.

In this arrangement, the invention provides a control element that discriminates between the medication administration criteria for actuating the first delivery mechanism and the medication administration criteria for actuating the second delivery mechanism. The control element thereby discriminates between the delivery of medication housed in the first and second storage locations.

Other features and advantages of the invention will become apparent upon reviewing the following detailed description, drawings, and appended claims.

DESCRIPTION OF THE PREFERRED EMBODIMENTS

Figure 1:
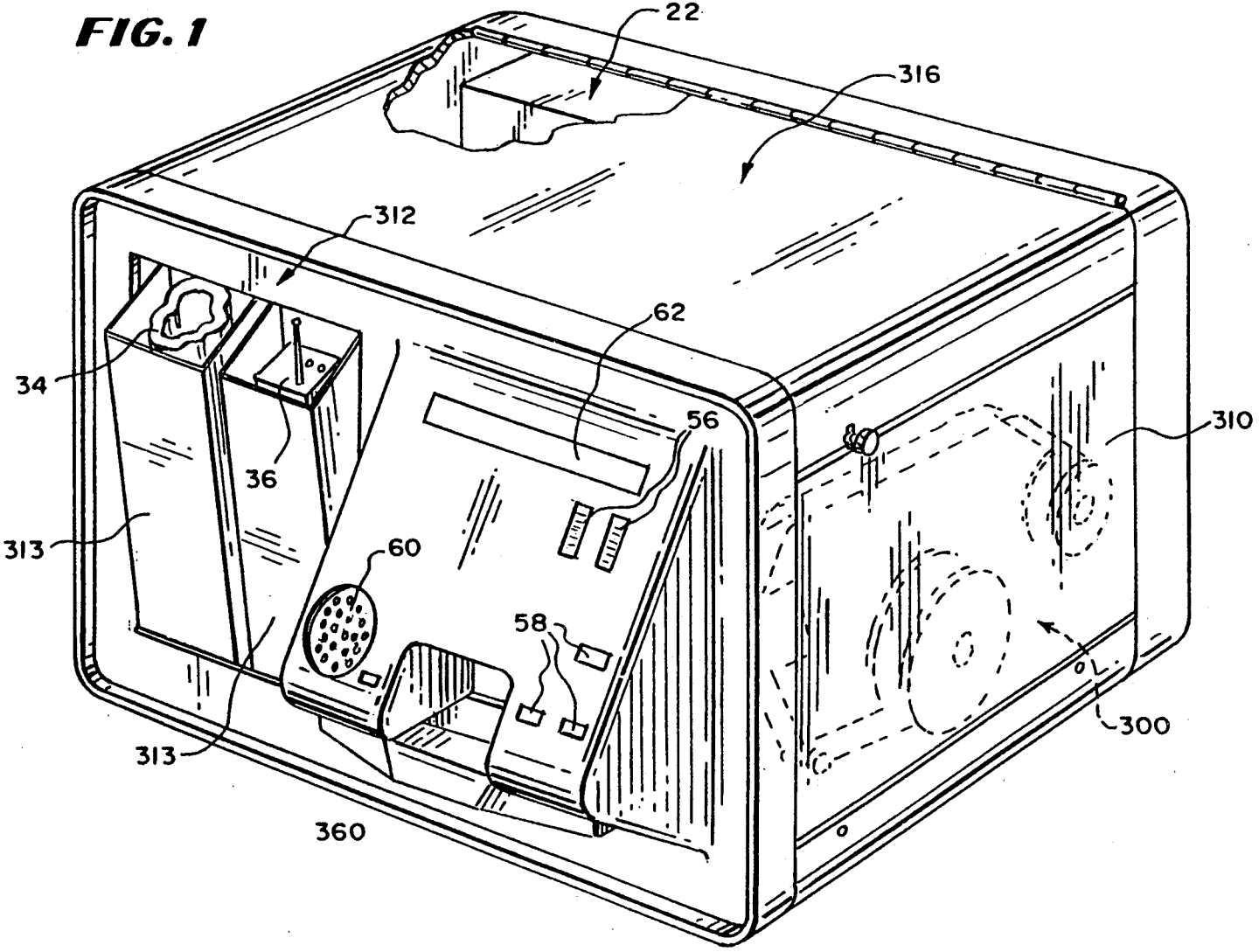
FIG. 1 is a front perspective view of another patient assistance device having an enclosed system for that embodies the features of the invention for storing and dispensing medication in individually sealed packets on a roll.

An interactive monitoring and assistance device 310 is shown in FIG. 1. As will soon be described in greater detail, the device 310 performs, as a self-contained, microprocessor-based caregiver who, in a friendly and supportive manner, monitors, manages and assists a patient in performing everyday health maintenance tasks.

In carrying out its tasks, the device 310 includes a system 312 that monitors the patient's vital signs. The device 310 also includes a system 300 that stores and administers medication. The device 310 preferably is linked to a central facility that provides round-the-clock supervision and response as required.

Figure 2A:
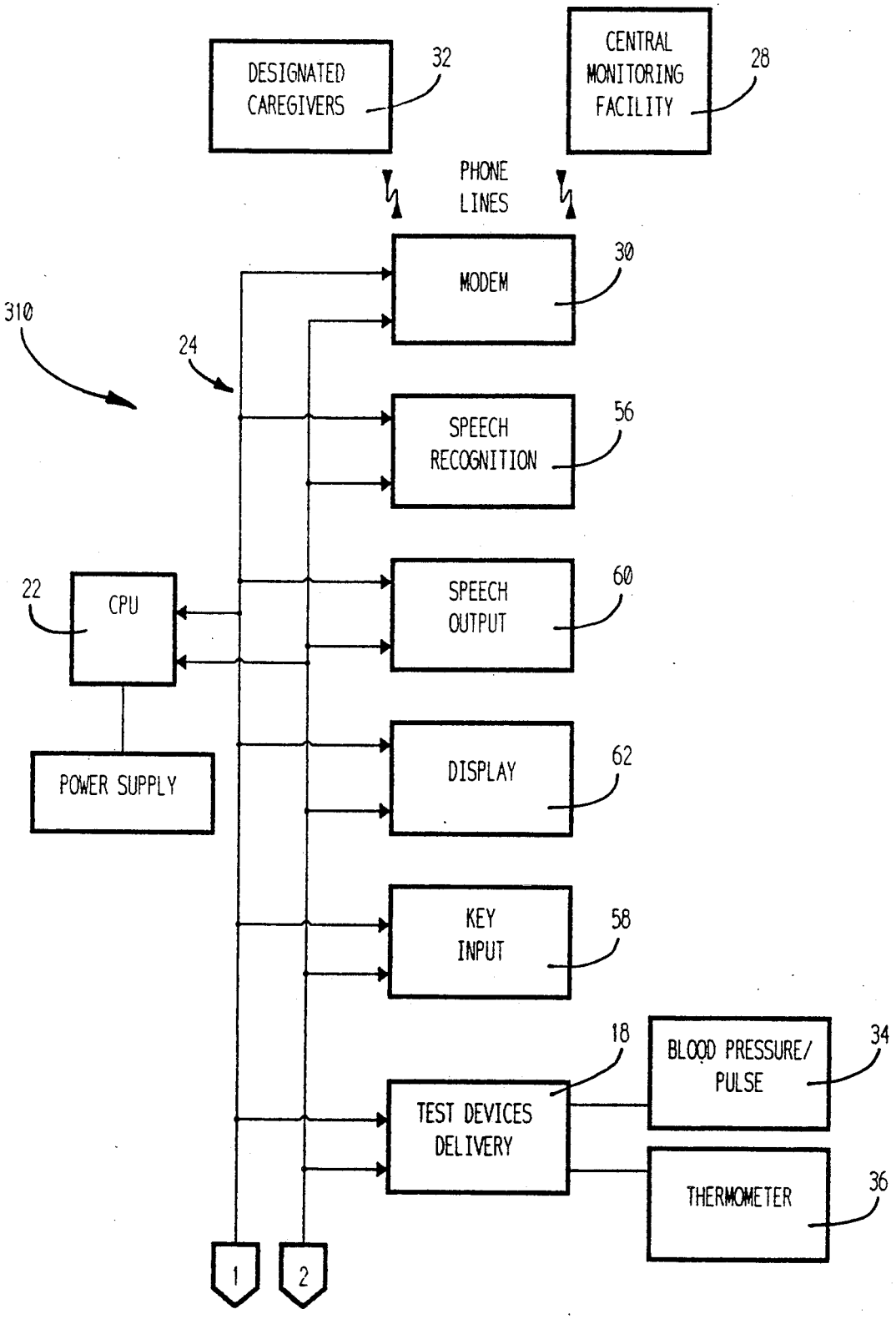
FIGS. 2*a*, 2*b* are schematic block diagram of the system that controls the operation of the patient assist device shown in FIG. 1.
Figure 2B:
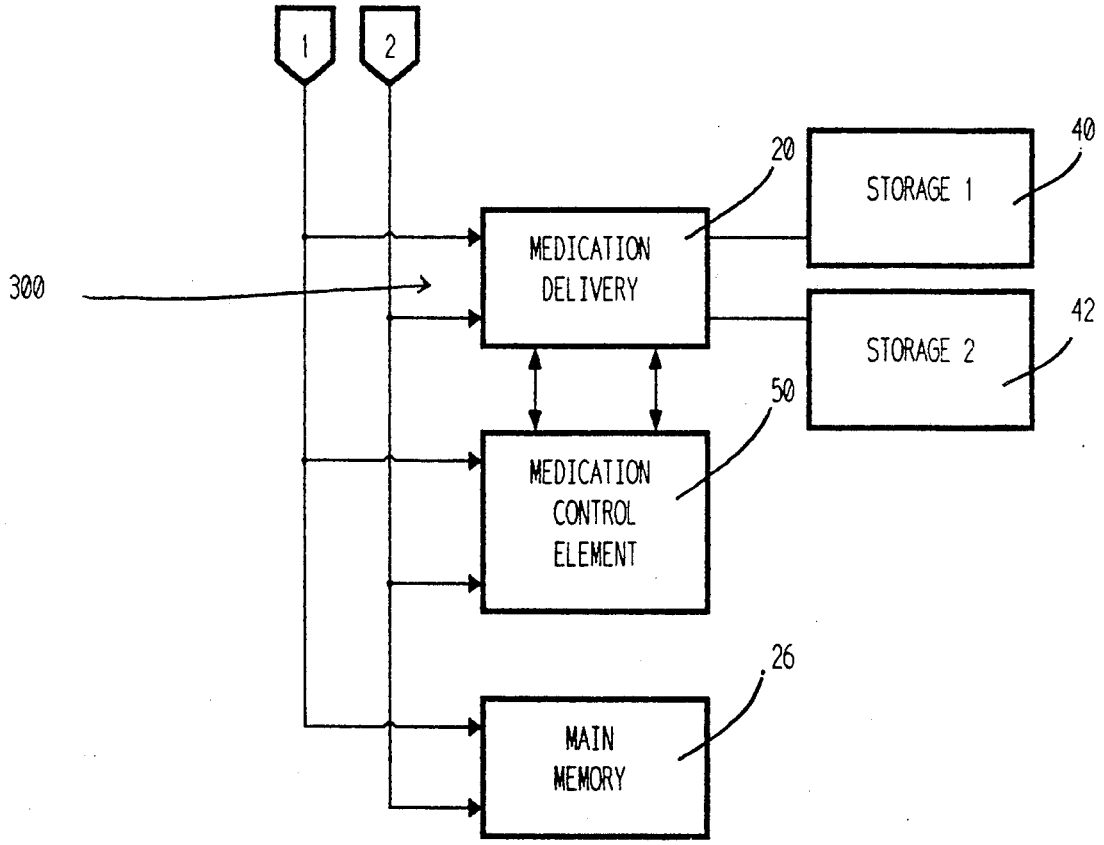

In the illustrated and preferred embodiment shown in FIG. 2, the device 310 houses a main microprocessor-based CPU 22 that coordinates and controls its operation. While various arrangements are possible, the CPU 22 preferably comprises an IBM PC compatible CPU board that accommodates multi-tasking sequences. Various input/output (I/O) devices communicate with the main CPU 22 through conventional data and address busses 24. The I/O devices will be described in greater detail later. A mass storage device 26 for storing digital information also communicates with the main CPU 22 through the busses 24.

In use, as shown in FIG. 2, the device 310 is preferably linked with a central monitoring facility 28 by a modem 30 that communicates with the main CPU 22 through the busses 24. Health care professionals are present on a twenty-four hour basis at the central facility 28 to monitor the health of the patient based upon information collected and transmitted to them by the device 310. The device 310 is also preferably linked via the modem 30 with selected individuals 32—typically close friends, family members, or other designated caregivers—who are automatically notified by the device 310 when certain health conditions exist or upon request by the patient or central facility 28. As can be seen, the device 310 is a central part of an overall support system for the patient.

The system 312 for monitoring the patient's vital signs includes two physical testing devices: a pressure cuff 34 for measuring blood pressure and pulse rate, and a thermometer 36 for measuring body temperature. Of course, other testing devices could be provided, depending upon the health condition of the patient and mode of treatment.

As shown in FIG. 2, the testing devices 34 and 36 communicate with the main CPU 22 through the busses 24. The measurements taken are stored in the data storage device 26. These measurements are also periodically transmitted to the central monitoring facility 28 by the modem 30. The central facility 28 also preferably records received information in its own mass storage device for record keeping, retrieval and analysis.

Preferably, the testing devices 34 and 36 are each housed in their own compartment or drawer 313 (see FIG. 1).

The medication delivery system 300 housed within the device 310 (best shown in FIG. 2) embodies the features of the invention.

The system 300 stores and delivers individual pills or caplets 302 prepackaged in individually sealed pockets 304 spaced along a continuous strip 306 that is typically stored on a roll 308. Typically the strip 306 is made of plastic, cellophane, paper foil, or foil and paper materials, and the pockets 304 are formed by conventional heat sealing techniques.

As will be described in greater detail later, the system 300 includes a dispensing mechanism 314 that automatically removes the medication from the sealed pockets 304 and dispenses it as individual pills/caplets 302 to the patient.

In the illustrated embodiment, the medication storage and delivery system 300 is carried within the device 310 next to the compartments 313 that contain the testing devices (see FIG. 1). The top wall 316 of the device is hinged, allowing it to be opened to gain access to the system 300 for service and to load medication.

Figure 3:
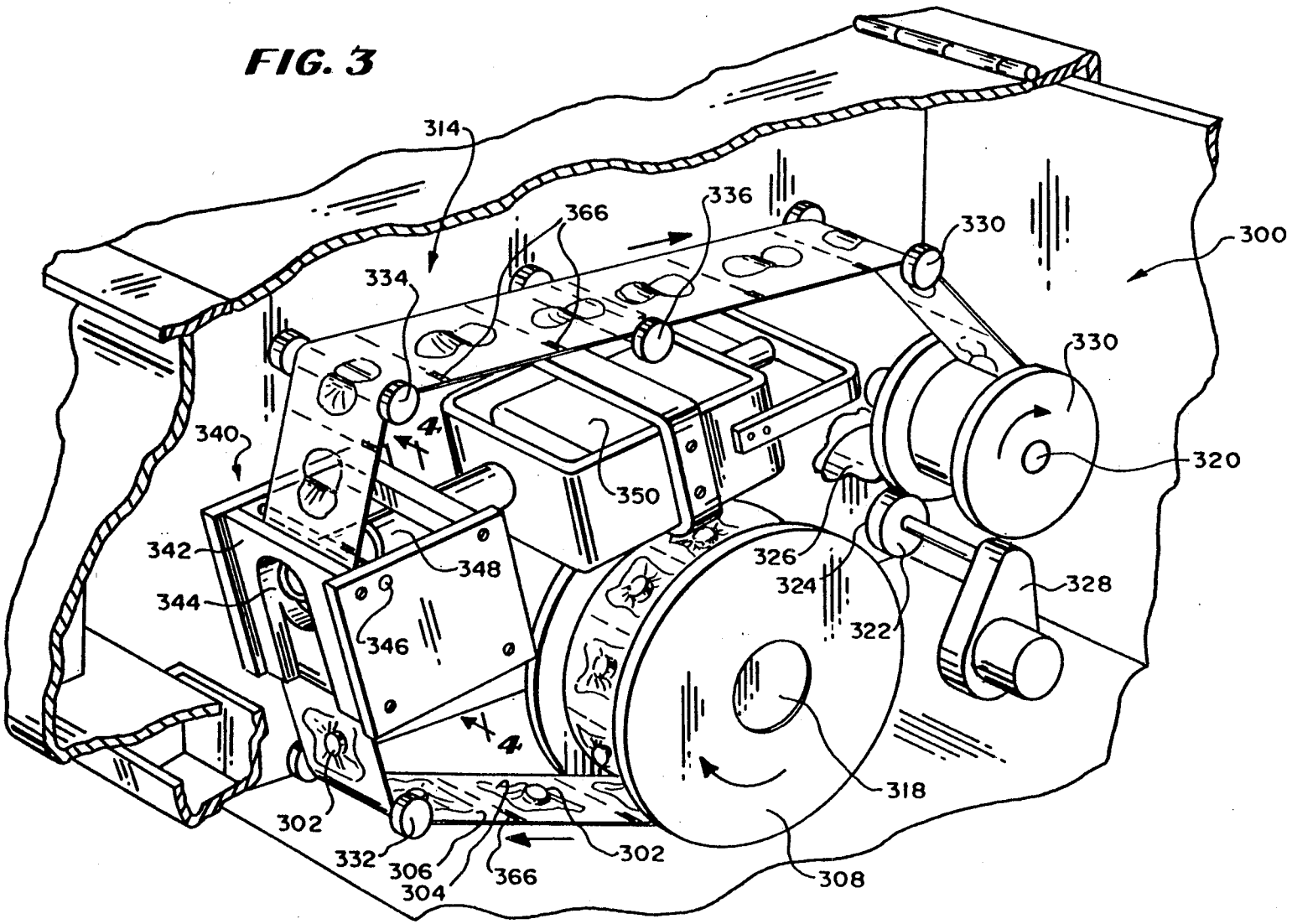
FIG. 3 is an enlarged perspective view of the interior of the device shown in FIG. 1, showing the details of construction of the associated medication dispenser.

As best shown in FIG. 3, the medication delivery system 300 includes an idler shaft 318 and a drive shaft 320. The idler shaft 318 is free to rotate in response to an external force. The drive shaft 320 is coupled to, via a drive gear 322, the drive shaft 324 of an electric motor 326 for rotation, which in the illustrated embodiment is in a clockwise direction. A crank 328 is also linked to the drive gear 322, permitting the user to manually rotate the drive shaft 320.

The idler shaft 318 receives the roll 308 of pills/caplets. The roll 308 can be easily slipped on to or removed from the idler shaft 318. Once inserted, the roll 308 rotates in common with the idler shaft 318.

The drive shaft 320 receives a take up reel 330, which also can be easily inserted and removed. Once inserted, the take up reel 330 rotates in common with the drive shaft 320.

The strip of pills is threaded from the roll 308 through the associated dispensing mechanism 314 and onto the take up reel 330. The strip 306 is guided in a desired path from the roll 308 to the take, up reel 330 through the dispensing mechanism 314 by a series of idler rollers 332/334/336/338. The idler rollers 332/334/336/338 also maintain a desired degree of tension in the strip 306.

As the take up reel 330 is rotated by the motor 326 in a clockwise direction, the strip 306 advances from the roll 308 onto the take up reel 330, through the dispensing mechanism 314.

Figure 4:
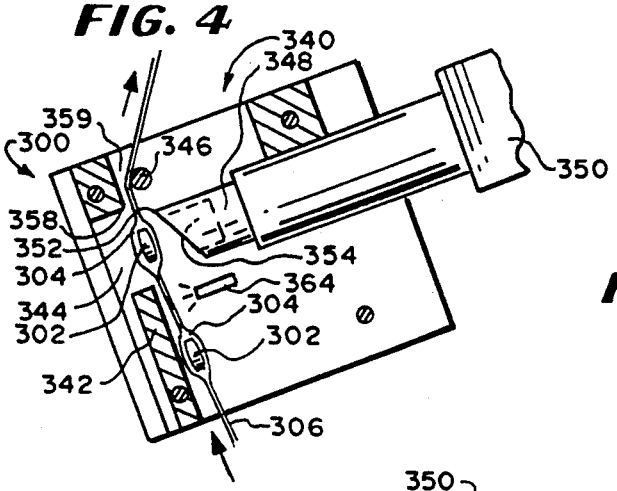
FIGS. 4 to 9 are enlarged side views, the even numbered of which are shown in perspective, illustrating the sequence of operation in dispensing medication in sealed packets on a roll.
Figure 5:
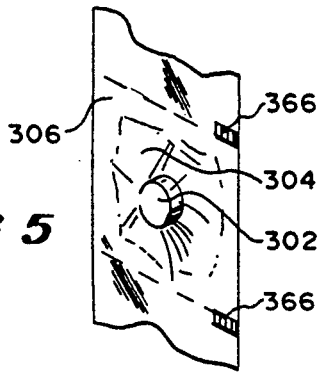

With reference now also to FIG. 4, the dispensing mechanism 314 includes an assembly 340 for expelling the pills/caplets from the strip 306. In the illustrated arrangement, the assembly 340 punches a hole in the strip 306 to expel the pill/caplet. The punch assembly 340 includes a base 342 having a punch hole 344. The strip 306 is advanced from the roll 308, around the first idler roller 332, through the punch assembly 340, and then around the second idler roller 334 on its path toward the take up reel 330. The punch assembly 340 includes an intermediate idler roller 346 around which the strip 306 passes. This intermediate roller 346, together with the first and second rollers 332 and 334, maintain the strip 306 in tension and in close proximity to the punch base 342 as it advances through the punch assembly 340. During this passage, each sealed medication containing pocket 304 is sequentially placed into registry over the punch hole 344.

Figure 6:
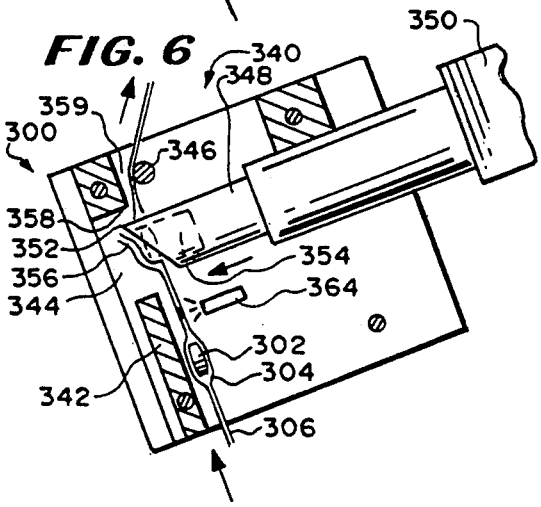

A reciprocating punch member 348 is movable from a retracted position, spaced from the punch hole 344 (see FIG. 4), to an extending position within the punch hole 344 (see FIG. 6). In the illustrated embodiment, the punch member 348 is normally biased toward the retracted position. An electrically actuated solenoid 350 drives the punch member 348 into its extended position. The biasing force then returns, the punch member 348 back t its normally retracted position.

Figure 7:
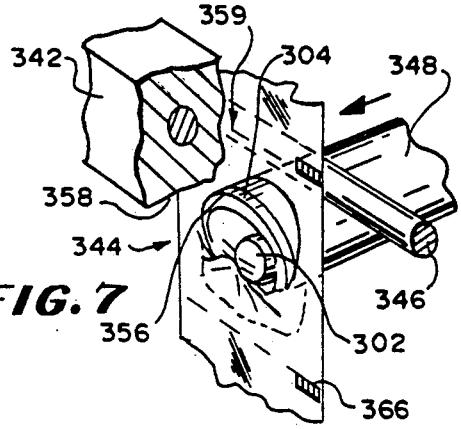

The outer end of the punch member 348 is tapered to a point 352 at its upper edge and also includes a cut out interior bore 354. When a medication containing pocket 304 occupies the punch hole 344, the pointed upper edge 352 of the punch member 348 cuts into the pocket 304 as the punch member 348 is driven into its extended position (see FIGS. 6 and 7). As best shown in FIG. 7, the pointed end 352 of the punch member 348 penetrates the pocket 304, bringing the pill/caplet into the confines of the bore 354. The bore 354 thereby restricts movement of the pill/caplet within the pocket 304 as the punch member 348 moves into its fully extended position. This action cuts a flap 356 that opens the pocket 304.

In an alternate arrangement, the outer end of the punch member 348 could be oppositely tapered, with the point located at its lower edge. In this arrangement, the flap would open downwardly, instead of upwardly as shown in the drawings.

Figure 8:
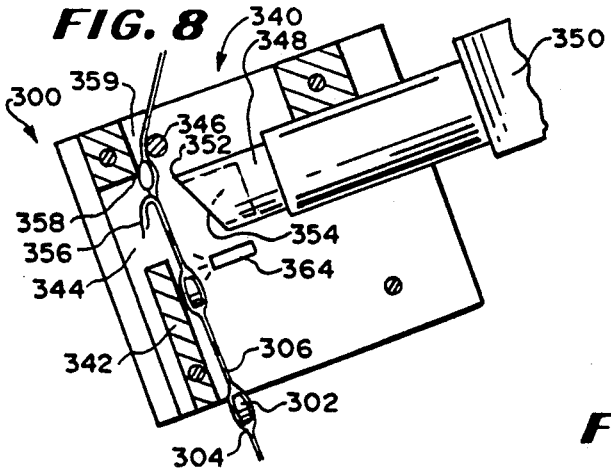
Figure 9:
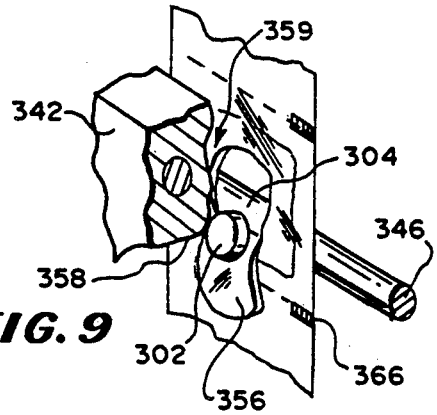

As the punch member 348 is withdrawn and the strip 306 is further advanced, the pill/caplet 302 is moved between the intermediate roller 346 and the rear (or. in the illustrated configuration, upper) lip or edge 358 of the punch hole 344 (see FIGS. 8 and 9). A restricted passage 359 is formed between the roller member 346 and the edge 358. As the strip 306 advances through this restricted passage 359, the roller member 346 presses the strip 308 against the edge 358. This pressing engagement peels back the flap 356 and expels the pill/caplet 302 from the pocket 304. The freed pill/caplet 302 falls into a delivery bin 360 (see FIG. 1 also).

In the alternate arrangement, in which the, flap opens downwardly, the pressing engagement serves to push the pill/caplet from the pocket without peeling back the flap.

The cut open strip 306, now free of medication, is advanced toward the take up reel 330.

Figure 12:
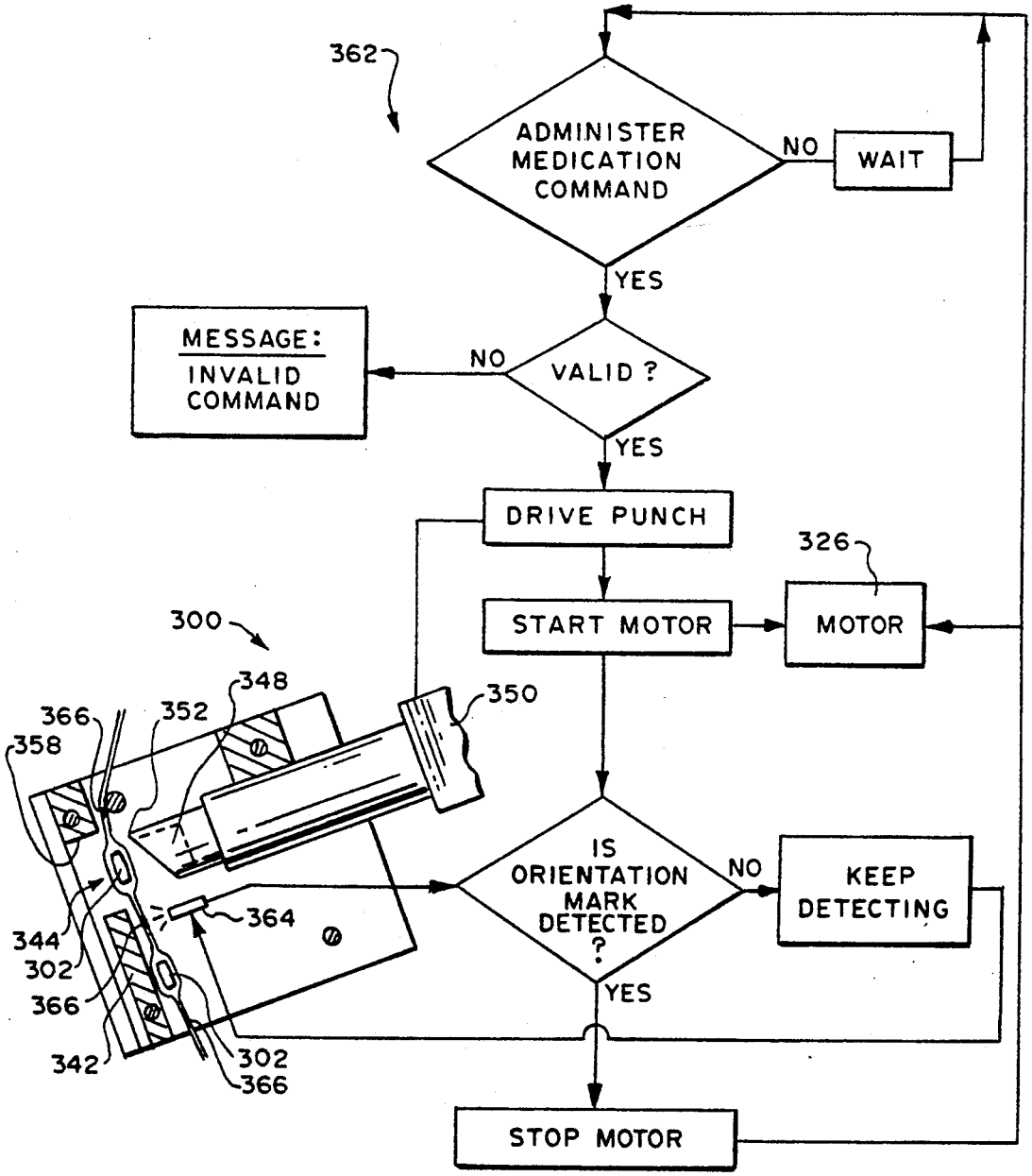
FIG. 12 is a schematic and partially diagrammatic flow chart of a control system for the medication dispenser shown in FIG. 3.

The medication delivery system 300 includes an additional control element 362 (see FIG. 12) that coordinates the advancement Of the strip 306 with the actuation of the punch member 348. The control element 362 can be variously constructed. In the illustrated embodiment (see FIG. 12), an optical sensor 364 is located to detect the presence of medication pockets along the strip 306 by sensing orientation marks 366 printed on the strip 306.

The medication administration cycle begins with the strip 306 occupying the position shown in FIG. 4. When a valid "Administer Medication" command is received, a "Drive" pulse is generated to the solenoid 350 of the punch member 348 to move the punch member 348 into its extended position (FIG. 6). The flap 356 is cut open. The punch member 348 automatically returns to its retracted position after receipt of the "Drive" pulse. At the same time, a "Start" signal is sent to the motor 326 to rotate the drive shaft 320. The strip 306 is advanced to eject the pill/caplet 302 through the flap 356 (as in FIG. 8). The strip 306 will continue to advance until the optical sensor 364 detects the presence of an orientation mark 366 on the strip 306. This orientation mark 366 is selectively positioned to come into alignment with the sensor 364 when a medication containing pocket 304 occupies the punch hole 344. The sensor 364 generates a "Stop" signal to the motor 326. Strip advancement is halted, with the next sequential pocket 304 occupying the punch hole 344 (as, in FIG. 4). Upon receipt of another valid "Administer Medication" command, the cycle repeats itself.

In an alternate arrangement, the pocket 304 could include preformed tear lines that define the flap 356. In this arrangement, the assembly 340 would push against the pill/caplet within the pocket 304 to open the preformed tear lines. The pill/caplet would thereby be expelled from the pocket 304.

Figure 10:
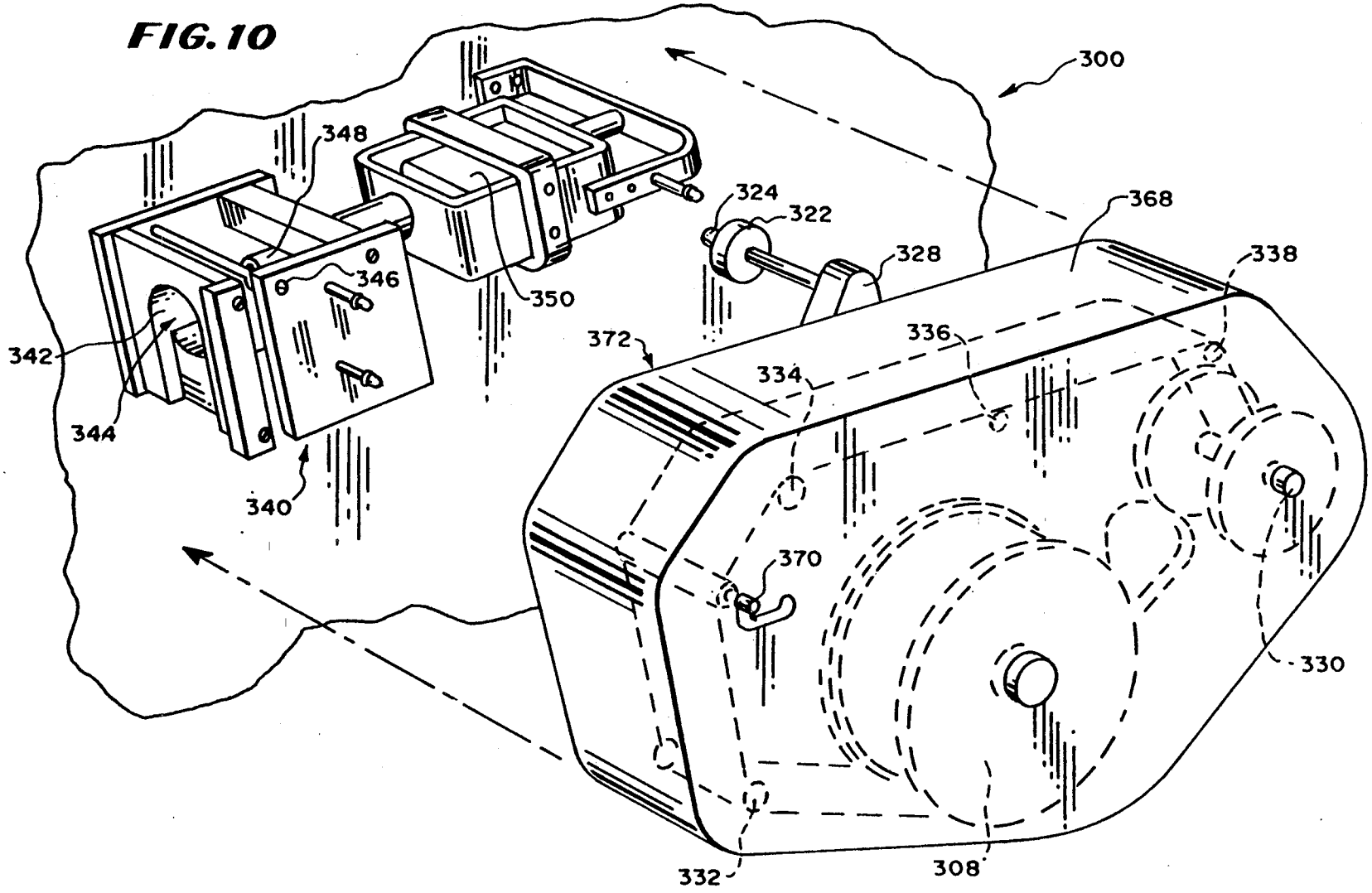
FIG. 10 is an enlarged perspective view of the interior of the device shown in FIG. 1 showing the details of construction of the associated medication dispenser with an associated prepackaged medication storage and dispensing cassette.

In a preferred arrangement (as shown in FIG. 10), a full roll 308 of medication, take up reel 330, and rollers 332/334/336/338 are prepackaged within a disposable cassette 368. The strip 306 is properly threaded within the cassette 368 from the roll 308 to the take up reel 330 and around the rollers 332/334/336/338 for installation as a unit into the medication dispensing mechanism 314. The cassette 368 includes an open back wall 372, allowing the cassette 368 to be installed about the punch assembly 340. When installed, the take up reel 330 carried within the cassette 368 makes operative contact with the drive gear 322 of the motor 326. To facilitate installation, the cassette 368 includes a movable roller 370 that temporarily holds the pre-threaded strip 306 in the proper path for placement within the punch assembly 340. As shown by arrows in FIG. 10, the temporary roller 370 is movable out of contact with the strip 306 once the strip 306 is engaged against the intermediate roller 346 of the punch assembly 340 (as shown in FIG. 4).

As in the previously described systems, it is contemplated that the cassette 368 will be prepacked by trained medical or pharmacy personnel at a location away from the device 310 and then carried on site.

Figure 11:
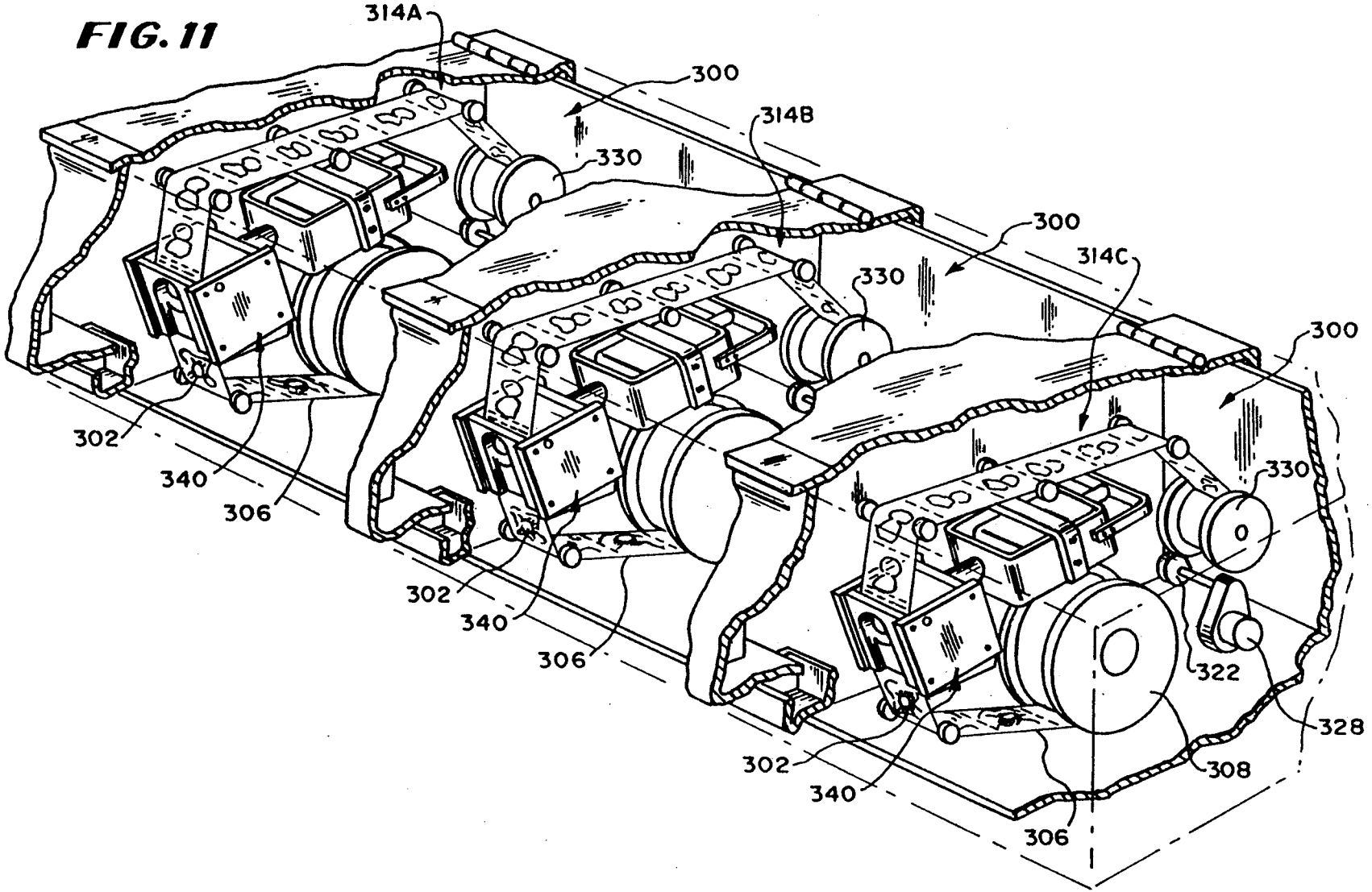
FIG. 11 is a perspective view of a multiple arrangement of the medication dispenser shown in FIG. 3.

In the embodiment shown in FIG. 1, only one, roll 308 and thus only one dispensing mechanism 314 is shown. It should be appreciated, however, that the system can accommodate multiple rolls of different medications by incorporating a like number of independently controlled dispensing systems 314 A/B/C, arranged either in a side-by-side or vertically stacked configuration (see FIG. 11).

In this multiple configuration, the system includes a control element 50 to independently control the separate dispensing mechanisms 314 A/B/C according to preselected input criteria. In this arrangement, the system 300 is capable of storing and administering different type of medications having different administration criteria. The criteria can differ in terms of prescribed dosage amount, prescribed frequency of administration, degree of accessibility to the patient, or various combinations of the above.

For the purposes of description, the interaction of the control element 50 with two of the dispensing mechanisms 314A and 314B will be described.

In the illustrated and preferred embodiment, the control element 50 communicates with the main CPU 22 (see FIG. 2), either in the form of programmable random access memory (RAM) or as preprogrammed read only memory (ROM).

Figure 13:
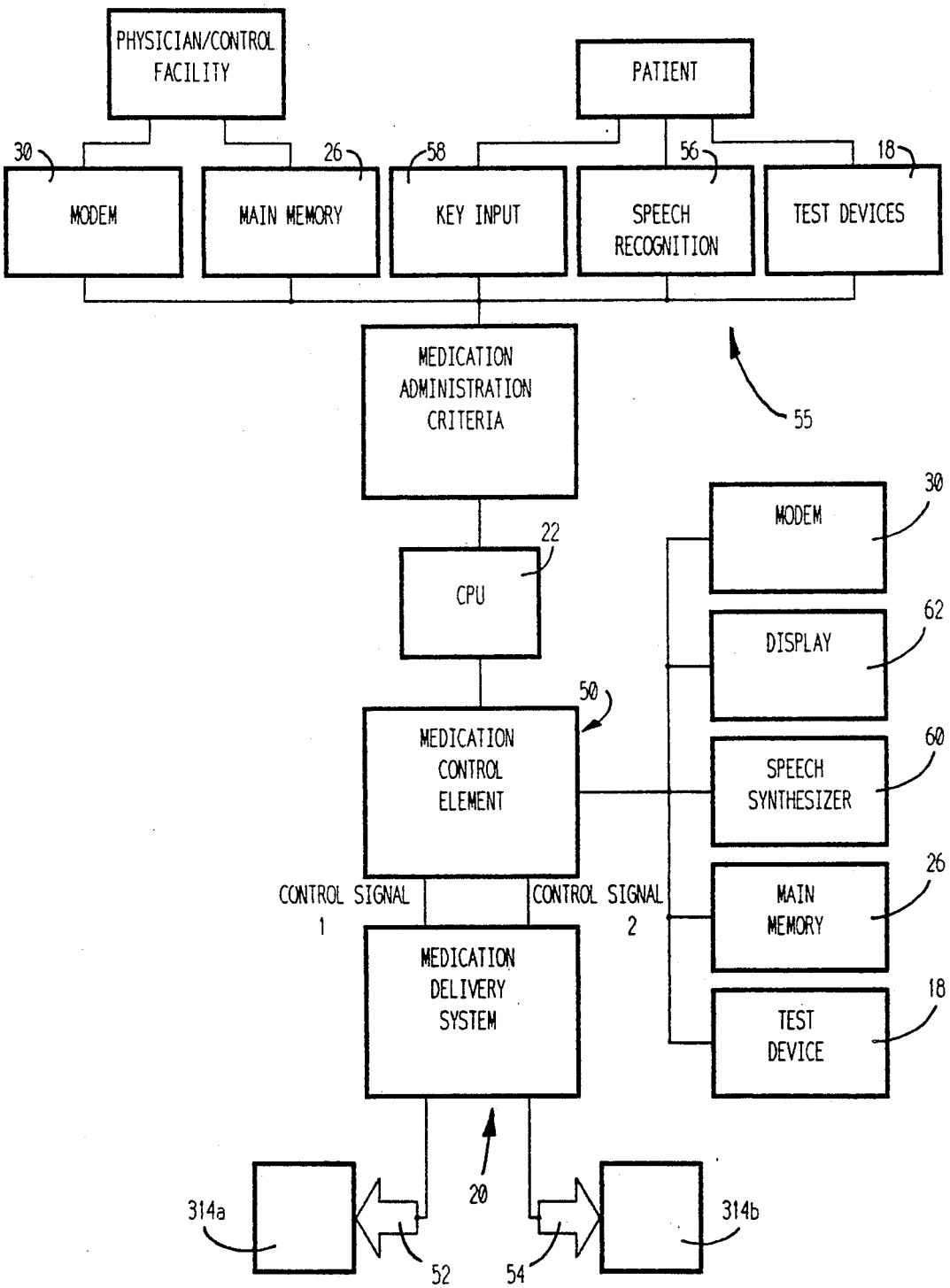
FIG. 13 is a schematic and partially diagrammatic block diagram of the elements of the system shown in FIG. 2 that control the operation of the medication delivery system that incorporates the invention.

As shown in FIG. 13, according to its programming, the control element 50 is capable of receiving and differentiating between at least two different prescribed inputs. Upon the receipt and interpretation a first prescribed input or combination of inputs, the control element 50 will generate a control signal 52 that actuates the first delivery mechanism 314A. Upon receipt of the second prescribed input or combination of inputs different from the first input, the control element 50 will generate, a control signal 54 that actuates the second delivery mechanism 314B. The control element 50 will not actuate the first delivery mechanism 314A in response to the second prescribed input.

Because the first and second control signals 52 and 54 are generated in response to different prescribed input criteria, the medications stored in the two storage compartments 314A and 314B can be selectively administered differently.

As best shown in FIG. 13, the input criteria that generate the first and second control signals are derived from both external and internal devices 55 associated with the medication delivery system 300. These devices receive input from internal memory 26, the physician (or healthcare professional), and the individual patient.

More particularly, the system 300 includes in internal memory 26 one or more prescribed schedules for administering medication. Here, the attending physician records the medication regime he or she has prescribed for the patient.

The system 300 also includes various external input devices for receiving and interpreting prescribed commands either from the patient or from the central monitoring facility 28. These external input devices communicate with the control element 50 through the main CPU 22 (see FIG. 2). The received commands can include one or more specified commands for administering medication "upon demand".

In the illustrated and preferred embodiment shown in FIGS. 2 and 13, the external input devices include a speech recognition system 56 for receiving and interpreting preselected verbal commands made by the patient (for example, by using a Texas Instruments Recognition and Speech Unit Model TI-2245186-001). The external input devices also include the modem 30 for receiving and interpreting preselected commands from the central facility 28.

In addition, the external input devices preferably include one or more input buttons or keys 58 located at a user-convenient place on the housing 12 (see FIG. 1). The keys 58 allow the patient to manually enter the prescribed medication delivery commands, if desired. In the illustrated and preferred embodiment shown in FIG. 1, only a select few input keys 58 for entering block (or macro-) commands are provided. This arrangement simplifies the patient's interface with the device 310. However, it should be appreciated that a full keyboard could also be included, depending upon the degree of sophistication and desires of the patient.

In the illustrated and preferred embodiment shown in FIGS. 2 and 13, the system 300 also includes an external output device associated with the main CPU 22 for delivering messages or otherwise communicating with the patient. Preferably, the external output device includes a speech generation system 60 for generating audible messages to the user. The speech generation system 60 can take the form of either a conventional device that synthesizes speech or a conventional device that digitizes prerecorded speech.

In addition, the external output device also preferably includes a video monitor 62 on which the audible messages appear in written form (see FIG. 1). In this arrangement, the video monitor 62 can also display in written form the preselected medication administration commands. In this way, the video monitor 62 serves to visually back up and confirm the verbal messages and commands being exchanged by the patient and the device 310, thereby minimizing ,the chance of misunderstandings or failures to communicate.

Due to these various input and output devices, the medication delivery system 300 as just described affirmatively interacts with the patient, relying upon both spoken and written forms of communication with the patient.

For example, the control element 50 as above described can store and selectively administer one category of medication that should be administered only according to a prescribed schedule and another category of medication that can be administered upon demand by the patient.

Figure 14A:
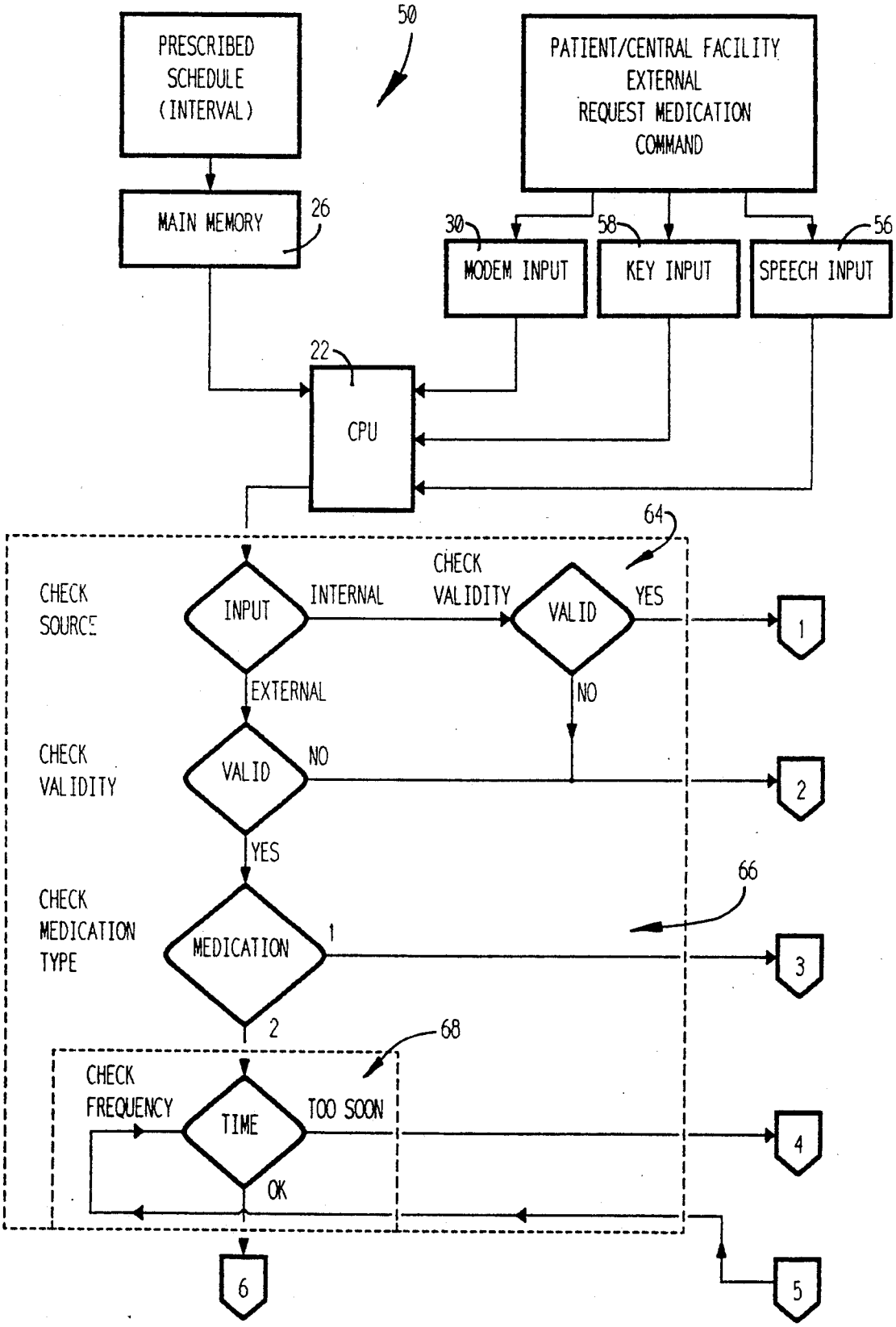
FIGS. 14*a*, 14*b* are schematic and partially diagrammatic flow chart of an embodiment of the system for controlling the operation of the medication delivery system that incorporate aspects of the invention.
Figure 14B:
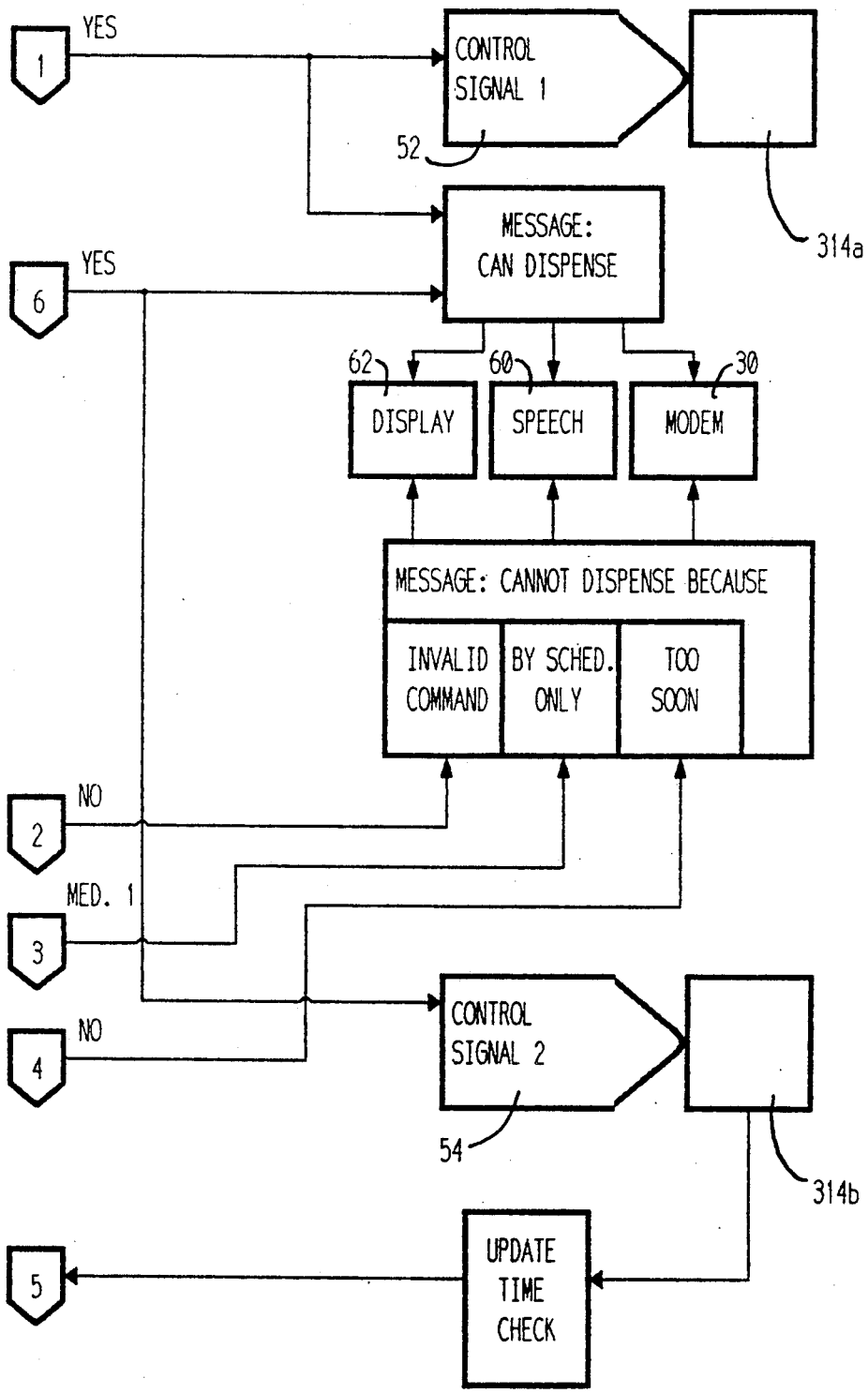

The control element 50 associated with this arrangement is shown diagrammatically in FIG. 14. The prescribed medication schedule is retained in the internal memory 26. The control element 50 includes a first operative sequence 64 that will generate the first control signal 52 upon receiving a valid administer medication command from an internal source (that is, a command generated internally based upon preprogrammed considerations). In the illustrated embodiment, the appropriate administer medication command is internally issued periodically by the CPU 22, based upon a continuous real time monitoring of the prescribed medication schedule stored in the internal memory 26.

Upon generation of the first control signal 52, medication retained in the first storage device 314A, and only the first storage device 314A, will be released to the patient.

Preferably, the first operative sequence 64 also generates a "Can Administer" message, using one or more of the output devices (the speech generator 60 and/or the display 62), advising the patient that, the prescribed medication is being dispensed according to schedule.

The control element 50 also includes a second operative sequence 66 that, in association with the external input devices (modem 30/key input 58/speech recognition 56), receives and interprets one or more medication delivery commands received from an external source, such as the patient or the central facility 28. As shown in FIG. 14, the second operative sequence 66 conducts a validity check upon the command. The second operative sequence 66 also checks to determine what type or category of medication is being requested.

Upon receipt of a valid command or commands requesting the proper type of medication, the second operative sequence 66 generates the second control signal 54. The medication retained in the second storage device 314B, but not the first storage device 314A, is thereby released to the patient.

The second operative sequence 66 also preferably communicates an appropriate "Can Administer" message to the patient through one or more of the output devices 60/62. If the medication request originates from the patient, an advisory message may also be sent to the central facility 28 via the modem 30 at the time an "on demand" request is received and implemented.

If an invalid command is received, or if the patient requests a medication that can only be administered according to an internal command from the internal memory, an appropriate "Cannot Dispense" message is display and/or spoken using the output devices 60/62.

Preferably, whenever a decision is made to either dispense medication or withhold medication, the, decision is recorded in internal memory 26 for record keeping purposes.

The first delivery mechanism 314A is thereby actuated in response to an internally generated command signal, but not in response to an externally generated command signal. The first category of medication can thus be safely retained within the first storage compartment 314A away from patient access, except as controlled by the control element 50 (via the first control signal 52). Strict compliance with the prescribed medication schedule is assured.

The second delivery mechanism 314B is actuated in response to the second control signal 54 based upon externally received commands. The second category of "on demand" medication can thus be safely retained in the second storage compartment 314B for administration externally controlled by the patient or the central facility 28 by issuing a proper external command.

In the illustrated and preferred embodiment shown in FIG. 14, the control element 50 also includes a third operative sequence 68 that maintains a real time record of "on demand" administrations of medication and the elapsed time period between them. The third operative sequence 68 includes timing means 70 for comparing the elapsed time between one actuation and the next subsequent actuation command to a prescribed fixed interval. The third operative sequence 68 will, based upon the output of the timing means 70, prevent the next subsequent actuation of the second delivery mechanism 314B, despite the receipt of a valid medication command, when the elapsed time period is less than the prescribed period.

In the illustrated and preferred embodiment, the third operative sequence 68 also informs the patient through an appropriate "Cannot Administer" message via one or more of the output devices 60/62. In addition, an advisory message can also be transmitted to the central facility 28 via the modem 30. In this way, the system guards against mismedication or overuse of the "on demand" category of medication.

It should be appreciated that all of the medication delivery systems described in this Specification are applicable for use out of association with a patient monitoring and assistance device. The systems can be used in virtually any environment where storage and delivery of selective medications are desired, such as in a hospital, nursing home, or pharmacy. It should also be appreciated that the medication delivery systems described can be actuated and controlled manually, without reliance upon the automated and highly interactive microprocessor controlled systems described in this Specification. Furthermore, each delivery mechanism and associated storage compartment can be used individually as a single unit, as well as in the multiple configurations shown in this Specification.

The features of the many aspects of the invention are set forth in the following claims.

We claim:

1. A dispensing device for medication that has been prepackaged in individual pockets along a strip, the dispensing device comprising a first holder for securing one end of the strip, a second holder for securing the opposite end of the strip, a dispensing mechanism, a drive mechanism for advancing the strip along a predetermined path leading from the first holder, through the dispensing mechanism and to the second holder, the dispensing mechanism including a first assembly that includes means for restricting movement of the medication within the pocket as the pocket is being opened and said assembly is movable into contact with the strip for opening a medication pocket and a second assembly that, as the strip is advanced, presses against the strip for expelling the medication from the opened pocket, and a control mechanism operatively connecting the drive mechanism and the dispensing for advancing the strip to bring a medication pocket into the first assembly, for moving the first assembly to open the pocket, and for advancing the opened pocket into second assembly to expel the medication from the pocket.

2. A dispensing device according to claim 1 wherein the first holder is a supply reel for holding the strip in roll form, wherein the second holder is a take up reel, and wherein the drive mechanism is operative for advancing the strip by winding the strip onto the take up reel while unwinding the strip from the supply reel.

3. A dispensing device according to claim 2 wherein the supply reel and the take up reel are located in an integral cassette removable and replaceable upon the dispensing mechanism and the drive mechanism.

4. A dispensing device according to claim 1 wherein the first assembly includes a punch member for cutting the strip to open a flap in the pocket.

5. A dispensing device according to claim 1 wherein the second assembly includes a surface having an edge and member that together form a restricted passage through which the strip passes as it is advanced and in which the member presses the advancing strip against the edge to expel the, medication through the open pocket.

6. A dispensing device according to claim 1 wherein the control mechanism includes optical sensing means for sensing the location of medication pockets on the strip and for generating a control signal when a medication pocket is in operative alignment with the dispensing mechanism.

7. A dispensing device for medication that has been prepackaged in individual pockets along a strip, the dispensing device comprising a supply reel for holding the strip in roll form, a take up reel for receiving the strip, a dispensing mechanism, a drive mechanism for unwinding the strip from the supply reel and winding it upon the take up reel to advance the strip along a predetermined path leading through the dispensing mechanism, the dispensing mechanism including a first assembly that is movable into contact with the strip for opening a medication pocket and includes means for restricting movement of the medication within the pocket as the pocket is being opened and a second assembly including a surface having an edge and member that together form a restricted passage through which the strip passes as it is advanced and in which the member presses the advancing strip against the edge to expel the medication through the open pocket, and a control mechanism operatively connecting the drive mechanism and the dispensing mechanism for advancing the strip to bring a medication pocket into the first assembly, for moving the first assembly to open the pocket, and for advancing the opened pocket through the restricted passage to expel the medication from the pocket.

8. A dispensing device according to claim 7 wherein the control mechanism includes optical sensing means for sensing the location of medication pockets on the strip and for generating a control signal when a medication pocket is in operative alignment with the first assembly.

9. A dispensing device according to claim 7 wherein the supply reel and the take up reel are located within an integral cassette that is removable and replaceable in operative contact with the dispensing mechanism and the drive mechanism.

10. A medication delivery system comprising a housing, separate first and second dispensing devices within the housing, each of the dispensing devices including storage means for storing at least one dose of a medication within the housing away from access by the user and delivery means associated with the storage means for selectively delivering a medication dose from the associated storage means to the user, at least one of the dispensing devices containing a medication dose that has been prepackaged in individual pockets along a strip, the storage and delivery means for this dispensing device comprising a first holder for securing one end of the strip, a second holder for securing the opposite end of the strip, a dispensing mechanism, a drive mechanism for advancing the strip along a predetermined path leading from the first holder, through the dispensing mechanism and to the second holder, the dispensing mechanism including a first assembly that is movable into contact with the strip for opening a medication pocket and a second assembly that, as the strip is advanced, presses against the strip for expelling the medication from the opened pocket, and a control mechanism operatively connecting the drive mechanism and the dispensing mechanism for advancing the strip to bring a medication pocket into the first assembly, for moving the first assembly to open the pocket, and for advancing the opened pocket into second assembly to expel the medication from the pocket, means associated with the system control means associated with the first and second storage means for actuating the delivery means associated with the first storage means in response to a first medication criteria and for actuating the delivery means associated with the second storage means in response to a second medication criteria different from the first medication criteria.

11. A dispensing device for medication that has been prepackaged in individual pockets along a strip, the dispensing device comprising a first holder for securing one end of the strip, a second holder for securing the opposite end of the strip, a dispensing mechanism, a drive mechanism for advancing the strip along a predetermined path leading from the first holder, through the dispensing mechanism and to the second holder, the dispensing mechanism including a first assembly that includes means that contacts the strip to cut a flap in a medication pocket and a second assembly which includes a surface having an edge and member that together form a restricted passage through which the strip passes as it is advanced and in which the member presses the advancing strip against the edge to expel the medication through the open flap, and a control mechanism operatively connected the drive mechanism and the dispensing mechanism for advancing the strip to bring a medication pocket into the first assembly to open the pocket, and for advancing the opened pocket into second assembly to expel the medication from the pocket.

* * * * *

UNITED STATES PATENT AND TRADEMARK OFFICE

CERTIFICATE OF CORRECTION

PATENT NO. : 5,102,008

DATED : April 7, 1992

INVENTOR(S) : Stephen Kaufman, Aleandro DiGianfilippo, Tamara Sager, James Hitchcock, Jr. and Mitchell Budniak It is certified that error appears in the above-indentified patent and that said Letters Patent is hereby corrected as shown below:

Column 10, line 44, after "dispensing" insert --mechanism--.

Column 10, lines 23 and 24, after "pocket," delete "means associated with the".

Signed and Sealed this

Twenty-first Day of June, 1994

Bruce Lehman

*Attest:*

BRUCE LEHMAN

*Attesting Officer*

*Commissioner of Patents and Trademarks*